US008832976B1

(12) United States Patent
Arabian et al.

(10) Patent No.: US 8,832,976 B1
(45) Date of Patent: Sep. 16, 2014

(54) BADGE HOLDER

(75) Inventors: Robert Arabian, Simi Valley, CA (US); Christopher Lee Dunn, Ventrua, CA (US)

(73) Assignee: Covered 6 LLC., Simi Valley, CA (US)

( * ) Notice: Subject to any disclaimer, the term of this patent is extended or adjusted under 35 U.S.C. 154(b) by 120 days.

(21) Appl. No.: 13/561,719

(22) Filed: Jul. 30, 2012

Related U.S. Application Data

(60) Provisional application No. 61/522,604, filed on Aug. 11, 2011.

(51) Int. Cl.
*A44C 3/00* (2006.01)
*G09F 3/20* (2006.01)

(52) U.S. Cl.
CPC ..... *A44C 3/001* (2013.01); *G09F 3/207* (2013.01)
USPC ..... 40/1.5

(58) Field of Classification Search
CPC ..... A44C 3/001; A44C 3/002; G09F 3/207
USPC ..... 40/1.5
See application file for complete search history.

(56) References Cited

U.S. PATENT DOCUMENTS

| | | | | |
|---|---|---|---|---|
| 821,547 | A * | 5/1906 | Stafford | 40/1.5 |
| 4,961,275 | A * | 10/1990 | Klein | 40/1.5 |
| 5,791,076 | A * | 8/1998 | Gailliard | 40/1.5 |
| 6,032,394 | A * | 3/2000 | Hand et al. | 40/651 |
| 6,108,957 | A * | 8/2000 | Zapawa | 40/654.01 |
| 6,339,866 | B1 * | 1/2002 | French | 24/306 |
| 6,766,932 | B2 * | 7/2004 | Hansen et al. | 224/604 |
| 7,454,856 | B2 * | 11/2008 | Passman | 40/661.04 |
| 2002/0145025 | A1 * | 10/2002 | Gilbert | 224/600 |
| 2008/0115396 | A1 * | 5/2008 | Gamboa | 40/661 |
| 2011/0192062 | A1 * | 8/2011 | Washington | 40/1.5 |

* cited by examiner

*Primary Examiner* — Kristina Junge
(74) *Attorney, Agent, or Firm* — Brooks Acordia IP Law, P.C.; Pejman Yedidsion; Christopher Weiss

(57) ABSTRACT

An apparatus for suspending or attaching a pinned badge that may identify a position, rank, and employer of an individual which may be attached to a belt, a ballistic bullet resistant vest, a helmet, a hat, a shirt, a jacket, or other articles of clothing, or suspended from a lanyard or necklace chain or other device.

5 Claims, 11 Drawing Sheets

BADGE HOLDER

CROSS-REFERENCE TO RELATED APPLICATION

This application claims priority to and the benefit of U.S. Provisional Patent Application Ser. No. 61/522,604, filed Aug. 11, 2011, which is hereby incorporated herein by reference in its entirety for all purposes.

BACKGROUND

The present invention is in the technical field of display devices. More specifically, an apparatus for suspending or attaching a pinned badge that may identify a position, rank, and employer of an individual that may be attached to a belt, a ballistic bullet resistant vest, a helmet, a hat, a shirt, a jacket, or other articles of clothing, or suspended from a lanyard or necklace chain or other devices.

SUMMARY

Exemplary embodiments include a badge holder comprising: a main badge holder comprising at least three backing members, where a first backing member may comprise a means for attaching a badge, a second backing member comprises at least one of: hook elements of a hook and loop fastening array and loop elements of a hook and loop fastening array, where the hook and loop fastening array may be disposed on an outer surface of the second backing member, and a third backing member may comprise a rigid material where the third backing member may be interposed between the first backing member and the second backing member and the at least three backing members may be stitched together; and at least one backing plate, where the at least one backing plate may comprise at least one of: (a) lanyard, (b) strapping, (c) loop elements of a hook and loop fastening array, and (d) hook elements of a hook and loop fastening array; where the main badge holder may be detachably attached to the at least one backing plate by the hook and loop fastening array. In additional embodiments, the means for attaching a badge may comprise two eyelets aligned vertically to a local plane. In other exemplary embodiments, the at least one backing plate may comprise at least three backing members: a first backing member, a second backing member comprising at least one of: hook elements of a hook and loop fastening array and loop elements of a hook and loop fastening array, the hook and loop fastening array disposed on an outer surface of the second backing member, and a third backing member comprising a rigid material where the third backing member may be interposed between the first backing member and the second backing member and the at least three backing members may be stitched together. In other exemplary embodiments, the first backing member of the at least one backing plate may comprise at least three pieces of webbing fabric sewn horizontally to a local plane across the surface of the first backing member, where each of the at least three pieces of webbing fabric may abut each other vertically to a local plane and may be attached end to end, and where a center stitch may be sewn orthogonally through the center of the at least three pieces of webbing fabric. In additional exemplary embodiments, the at least three pieces of webbing fabric may be about two inches. In additional exemplary embodiments, two pieces of webbing fabric may be attached perpendicular to the at least three pieces of webbing fabric sewn horizontally, and where the two pieces of webbing fabric may be sewed at one end proximate to a top edge of the first backing member and detachably attached at an opposite end of the first backing member by a detachable attachment device. In additional exemplary embodiments, the detachable attachment device may be at least one of: (a) button snaps and (b) hook or loop elements of hook and loop fasteners.

Exemplary embodiments also include a badge holder comprising: a main badge holder comprising at least three backing members, where a first backing member comprises at least one of: hook elements of a hook and loop fastening array and loop elements of a hook and loop fastening array, the hook and loop fastening array disposed on an outer surface of the first backing member, a second backing member comprises a means for holding and displaying an identification card disposed on an outer surface of the second backing member, and a third backing member comprising a rigid material, where the third backing member may be interposed between the first backing member and the second backing member and the at least three backing members may be stitched together. In additional exemplary embodiments, the badge holder may further comprise two reinforced eyelets that may be aligned horizontal to a local plane, where the reinforced eyelets go through the at least three backing members and may be proximate to a top edge of the main badge holder. In additional exemplary embodiments, the badge holder may further comprise a lanyard, wherein the lanyard may be slidably engaged through the two reinforced eyelets of the main badge holder. In additional exemplary embodiments, the main badge holder may further comprise a border, where the border may comprise two pieces of semi-rigid material disposed around the perimeter of the main badge holder and the border, and wherein the at least three backing members may be double-stitched together. In additional exemplary embodiments, the means for holding and displaying an identification card may be a transparent plastic, wherein the height of the transparent plastic may be less than the height of the second backing member and the transparent plastic may be attached to the second backing member on a bottom side, a left side, and a right side. In additional exemplary embodiments, the transparent plastic may be attached to the second backing member on the bottom side, the left side, and the right side by stitching. In additional exemplary embodiments, the badge holder may further comprise at least one badge backing, where the at least one badge backing may comprise at least one of loop elements of a hook and loop fastening array and hook elements of a hook and loop fastening array; and where the badge holder may be detachably attached to the main badge holder by the hook and loop fastening array.

BRIEF DESCRIPTION OF THE DRAWINGS

Embodiments are illustrated by way of example and not limitation in the figures of the accompanying drawings, and in which.

DETAILED DESCRIPTION

Figure 1:
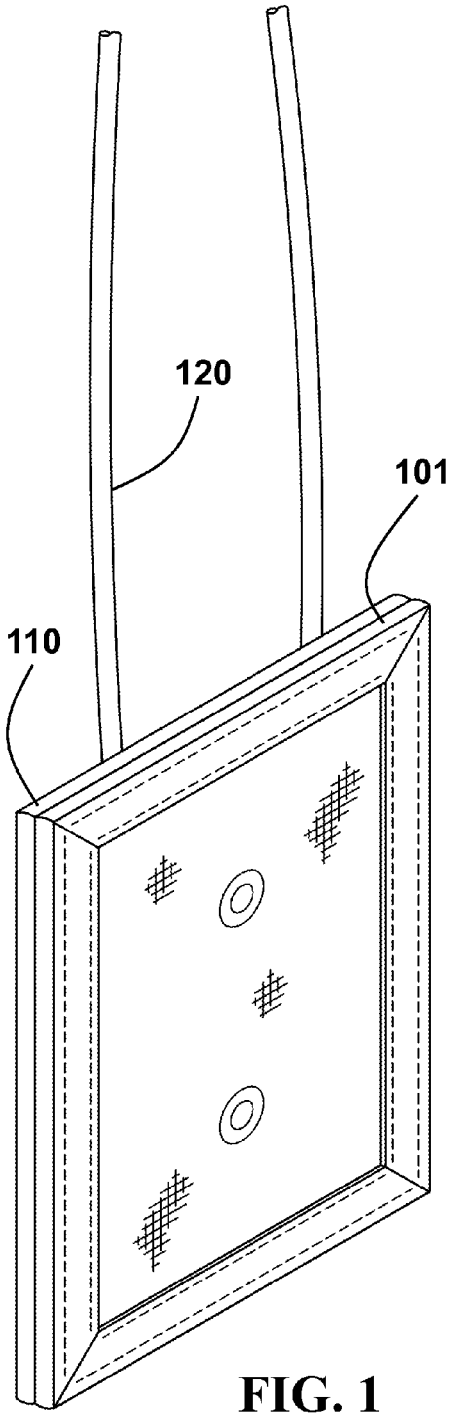
FIG. 1 is a perspective view of an exemplary Main Badge Holder detachably attached to an exemplary Badge Mount Receiver with lanyard.

FIG. 1 depicts a perspective view of an exemplary main badge holder 101 detachably attached to an exemplary badge mount receiver 110. The badge holding device may display the badge in multiple desired locations and may comprise two elements: the main badge holder 101, and the badge mount receiver 110. More than one badge mount receiver may be utilized to allow for quick transfer of the main badge holder 101 to one or more badge mount receivers 110. The rear surface of the main badge holder 101 may be attached to the front surface of the badge mount receiver 110 by hook or loop elements 130 of hook and loop fasteners. In one embodiment, the badge mount receiver may be attached via lanyard 120.

Figure 2:
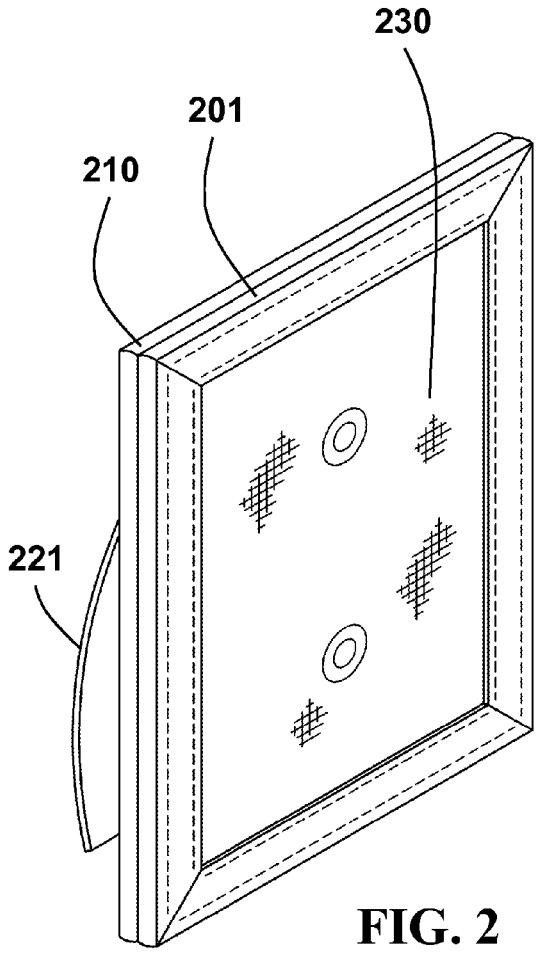
FIG. 2 is a perspective view of an exemplary Main Badge Holder detachably attached to an exemplary Badge Mount Receiver with strapping.

FIG. 2 depicts a perspective view of an exemplary main badge holder 201 detachably attached to an exemplary badge mount receiver 210. The rear surface of the main badge holder 201 may be attached to the front surface of badge mount receiver 210 by a hook and loop fastening array 230. In some embodiments, the badge mount receiver may be attached via strapping 221.

Figure 3:
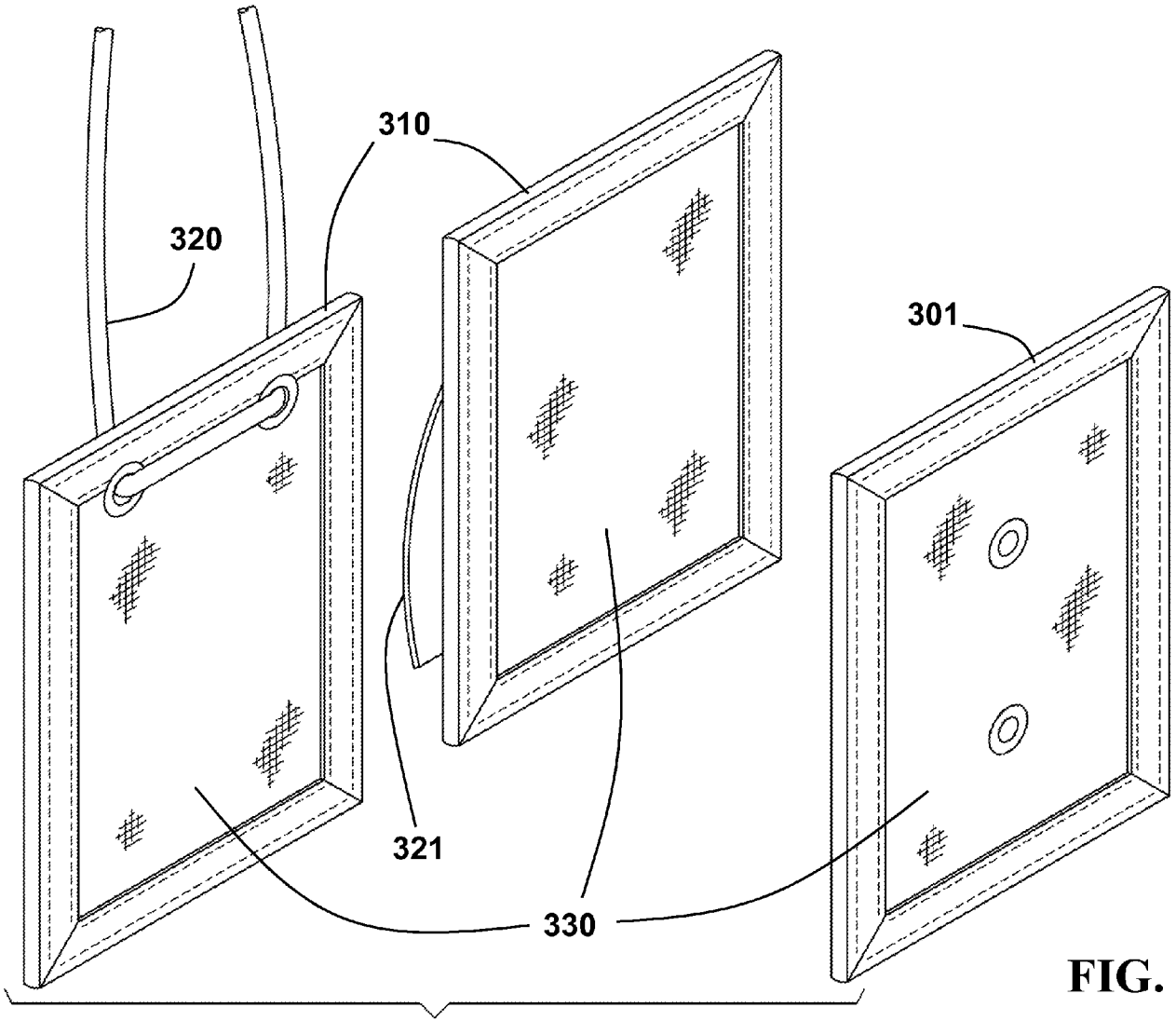
FIG. 3 depicts an exemplary Main Badge Holder detached from an exemplary Badge Mount Receiver with lanyard and the Badge Mount Receiver with strapping.

FIG. 3 depicts a perspective view of an exemplary detached main badge holder 301. The hook or loop elements of hook and loop fasteners 330 may allow for the easy transfer of the main badge holder between an exemplary badge mount receiver 310 with lanyard 320 and/or an exemplary badge mount receiver 310 with strapping 321.

Figure 4A:
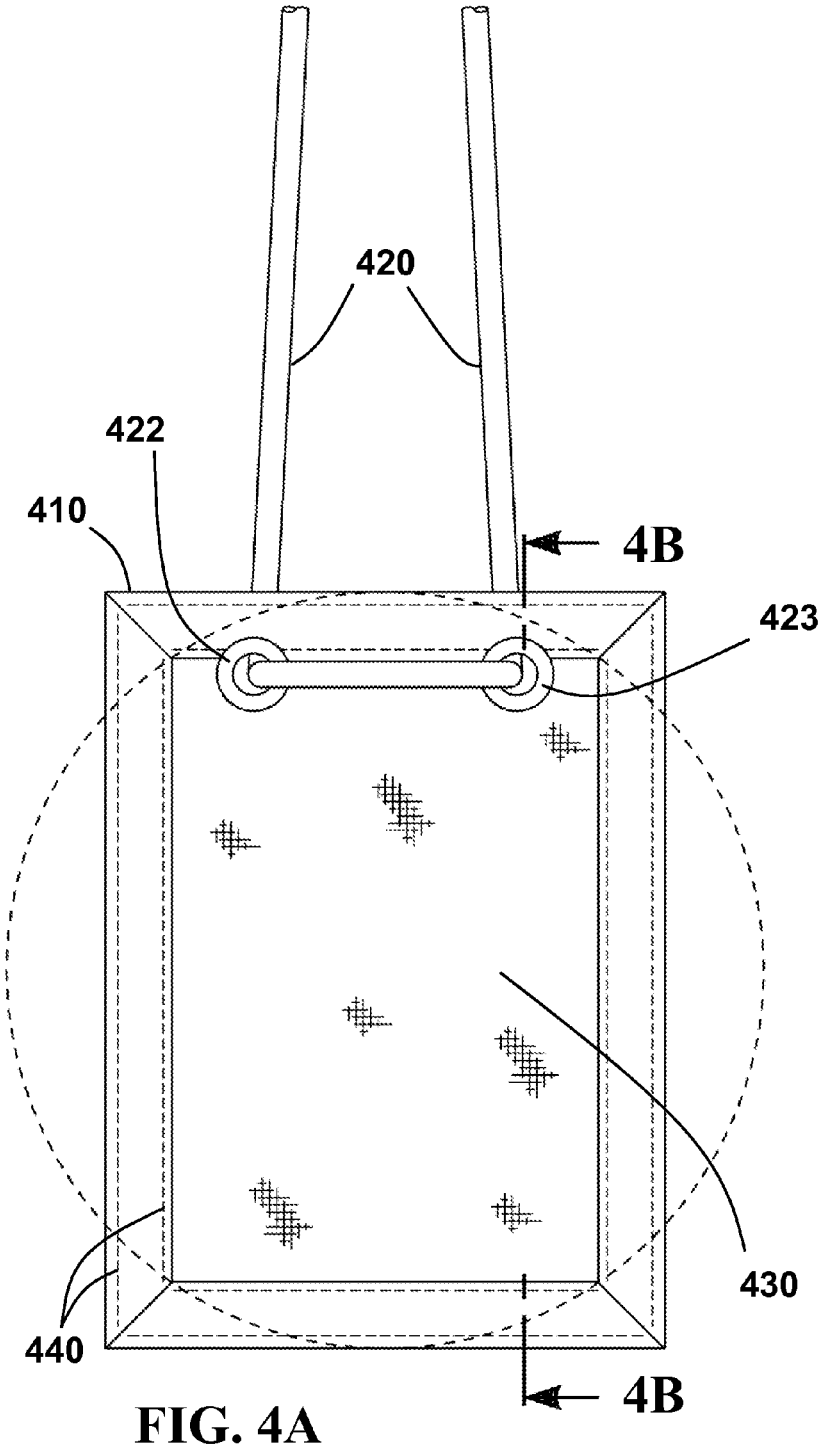
FIG. 4A is a perspective front view of an exemplary Badge Mount Receiver with lanyard.

FIG. 4A depicts a perspective front view of an exemplary badge mount receiver 410 with lanyard 420. A lanyard 420, for example, a metal chain or other neck chain, may be slidably engaged through two horizontal holes 422,423, e.g., grommets, spaced approximately two inches apart and approximately ⅛ inch from the top of the badge mount receiver. The two horizontal holes 422,423 may be reinforced to prevent the wear and widening of the fabric, for example, by aligned metal or nylon eyelets. In some embodiments, the front surface may be affixed with hook or loop elements 430 of hook and loop fasteners. In some embodiments, a border 440 comprised of two pieces of a semi-rigid material, e.g., cloth, of the same size may be double stitched around the perimeter to join the pieces together.

Figure 4B:
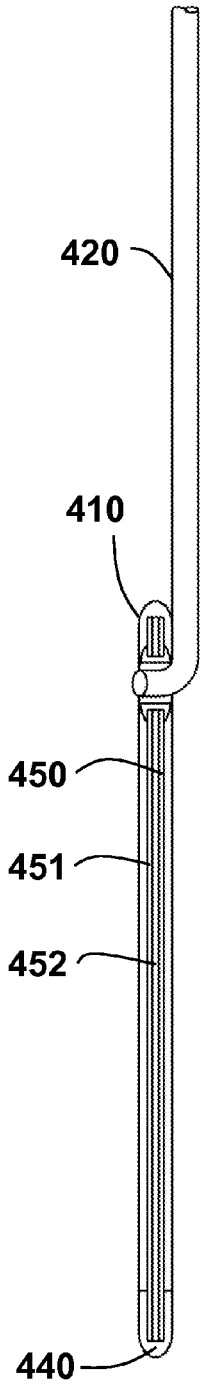
FIG. 4B is a cross-sectional view of an exemplary Badge Mount Receiver with lanyard.

FIG. 4B depicts a cross-sectional view of the exemplary badge mount receiver 410 with lanyard 420. The exemplary badge mount receiver may comprise at least three backing members. A first backing member 450 may be joined with hook or loop elements of hook and loop fastening material to allow for mounting of the main badge holder. A second backing member 451 may provide the outer surface opposite the first backing member, and a third backing member 452 may be interposed between the first backing member 450 and the second backing member 451 to provide rigidity. The at least three backing members 450,451,452 may be sewn together, for example, with double stitching, with a border 440 to join the at least three backing members 450,451,452.

Figure 5C:
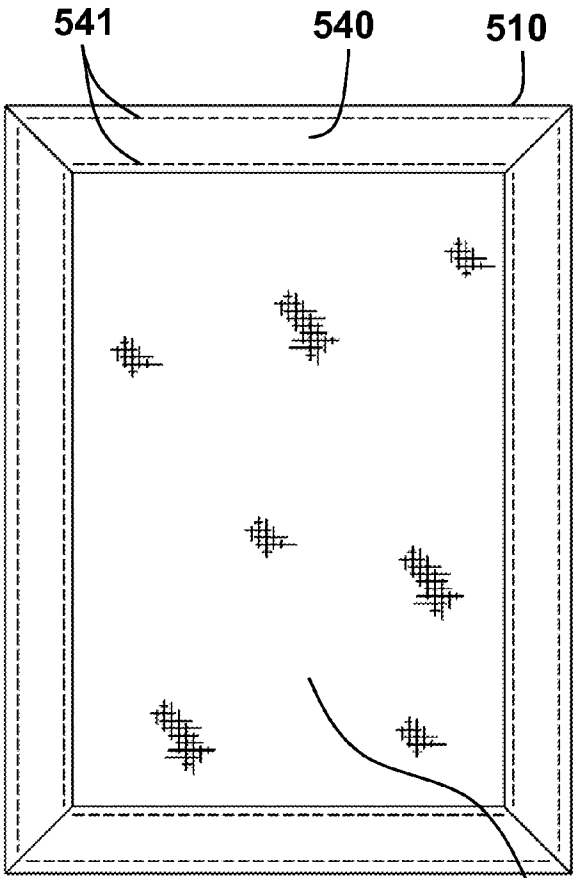
FIG. 5C is a perspective front view of an exemplary Badge Mount Receiver with strapping.
Figure 5B:
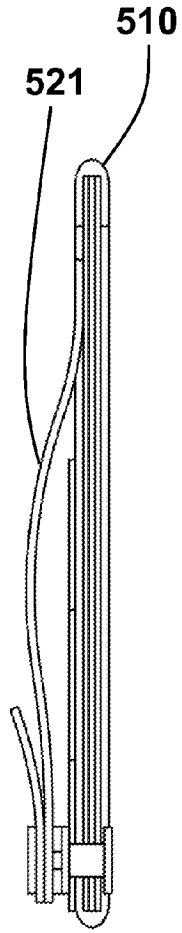
FIG. 5B is a cross-sectional view of an exemplary Badge Mount Receiver with strapping.
Figure 5A:
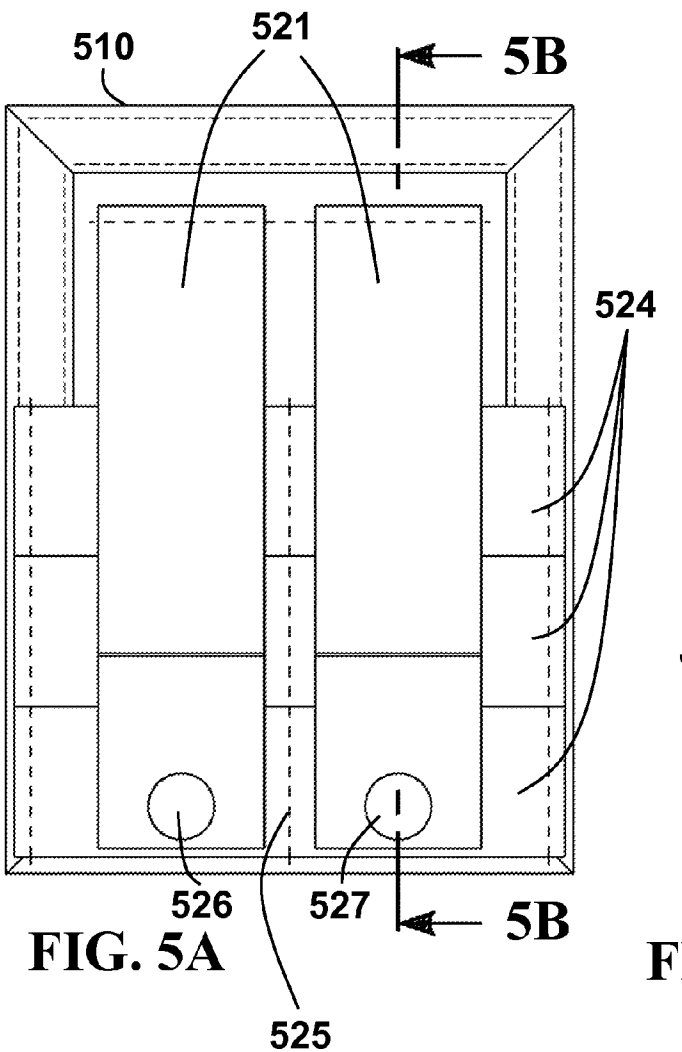
FIG. 5A is a perspective rear view of an exemplary Badge Mount Receiver with strapping.

FIG. 5A depicts a perspective rear view of an exemplary badge mount receiver 510 with strapping 521. The rear surface of the badge mount receiver may comprise three, approximately two inch pieces, of webbing fabric 524 sewn horizontally across the surface. Each of these three pieces of webbing fabric 524 may abut each other vertically and may be attached end to end. There may be stitching 525 sewn into the center of the surface, effectively creating two equal halves of these attachments. In addition to the three horizontal webbing pieces 524, there may be two 1¾ inch pieces of webbing fabric 521 sewn at the top. In some embodiments, on the bottom of the two 1¾ inch pieces of webbing fabric 521 there may be attachment devices 526,527, e.g., button snaps, in order to secure the straps through the three pieces of horizontal webbing 524.

FIG. 5B depicts a cross-sectional view of the badge mount receiver 510 with strapping 521. FIG. 5C depicts a perspective front view of the badge mount receiver 510 with strapping. The front surface may be affixed with hook or loop elements of hook and loop fasteners 530. A border 540 comprised of two pieces of a semi-rigid material, e.g., ballistic nylon, of the same size may be double stitched 541 around the perimeter to join the pieces together.

Figure 6B:
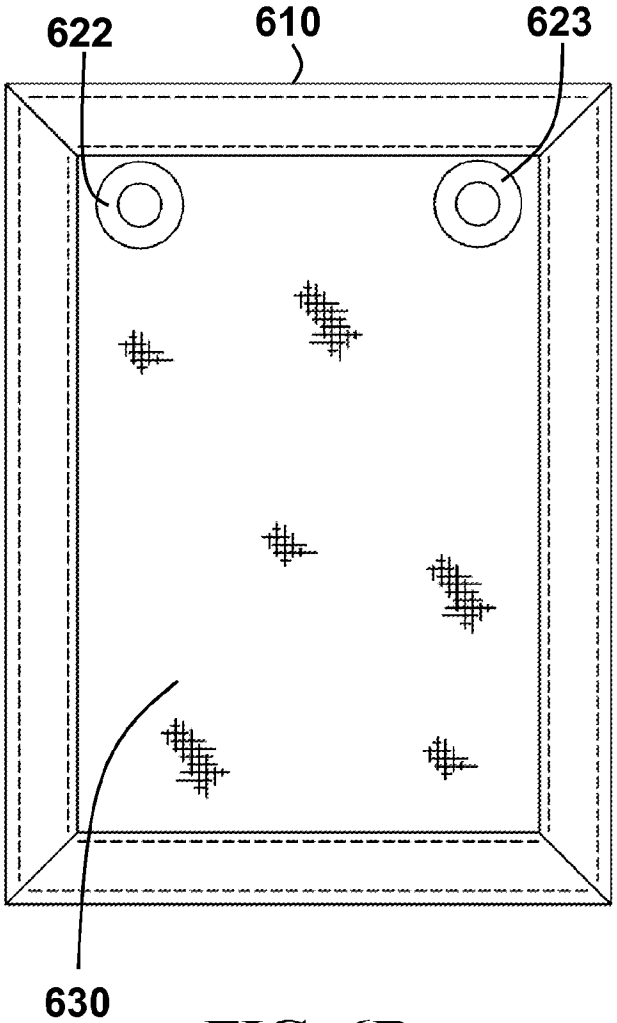
FIG. 6B is a perspective front view of an exemplary Badge Mount Receiver.
Figure 6A:
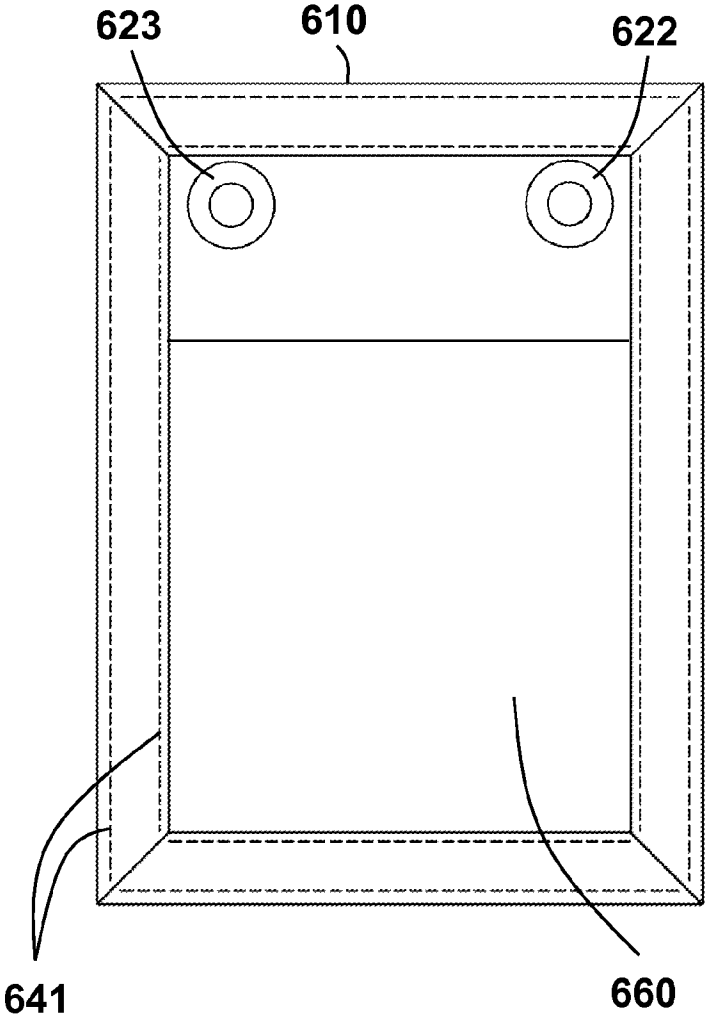
FIG. 6A is a perspective rear view of an exemplary Badge Mount Receiver with an ID Card window.

FIG. 6A is a perspective rear view of an exemplary Badge Mount Receiver 610 with an ID card window 660. The ID card window 660 may be of a transparent material, e.g., plastic, for holding and/or displaying an identification card. The ID card window 660 may be attached on three sides of the Badge Mount Receiver 610 by double stitches 641 and/or epoxy. A portion of the window proximate to the two horizontal holes 622,623 may be open to allow for the insertion and/or removal of a card.

Figure 6D:
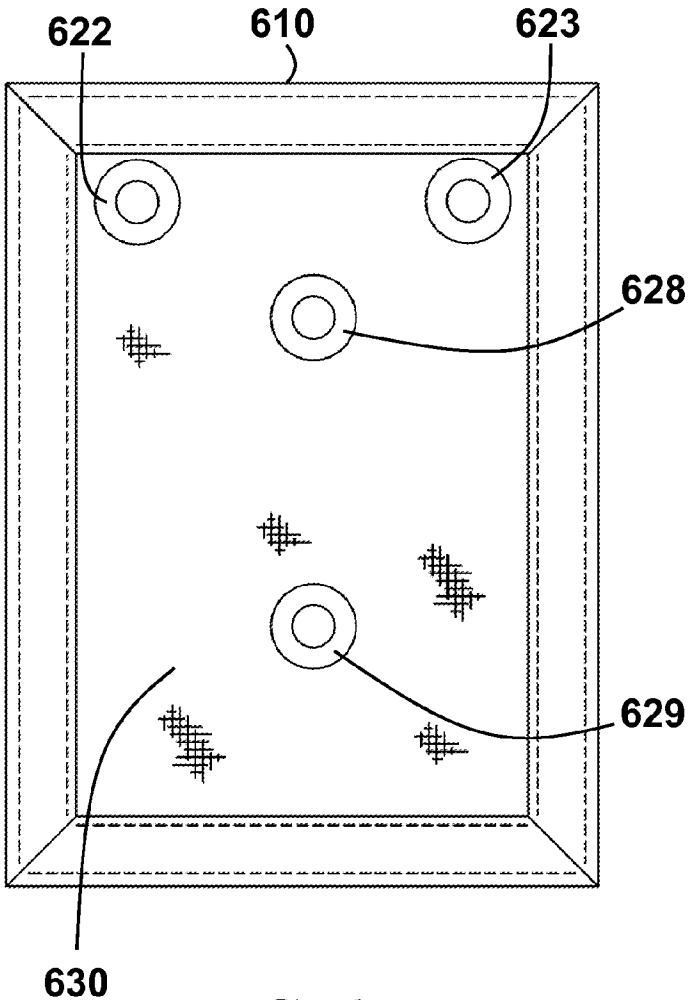
FIG. 6D is a perspective front view of an exemplary Badge Mount Receiver and Holder.
Figure 6C:
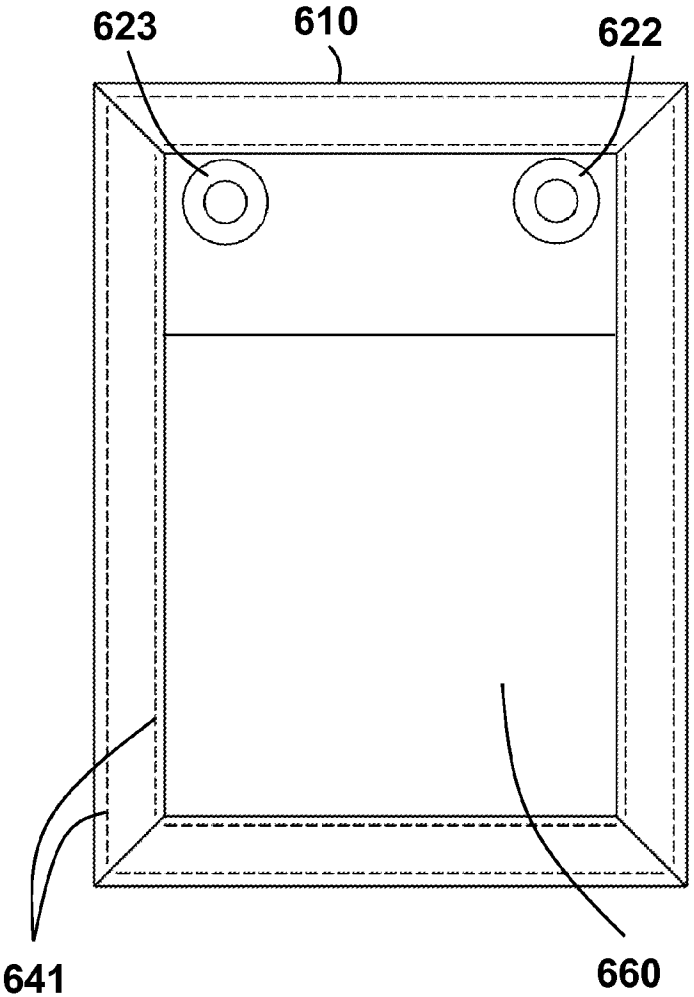
FIG. 6C is a perspective rear view of an exemplary Badge Mount Receiver and Holder with an ID Card window.

FIG. 6B is a perspective front view of an exemplary Badge Mount Receiver 610. The front surface may be affixed with hook or loop elements 630 of hook and loop fasteners. FIG. 6C is a perspective rear view of an exemplary Badge Mount Receiver and Holder 610 with an ID Card window 660. FIG. 6D is a perspective front view of an exemplary Badge Mount Receiver and Holder 610. The Badge Mount Receiver and Holder 610 may comprise two horizontal holes 622,623 spaced approximately two inches apart and approximately ⅛ inch from the top of the front surface of the badge mount receiver and holder 610. The front surface may also comprise two horizontally aligned holes 628,629 to accommodate a pin of a badge. In some embodiments, hook or loop elements of hook and loop fasteners 630 may be attached to the front surface of the Badge Mount Receiver and Holder 610.

Figure 7B:
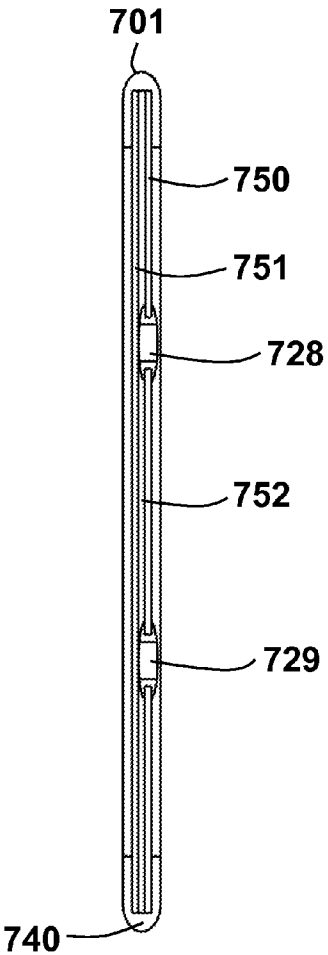
FIG. 7B is a cross-sectional view of an exemplary Main Badge Holder.
Figure 7A:
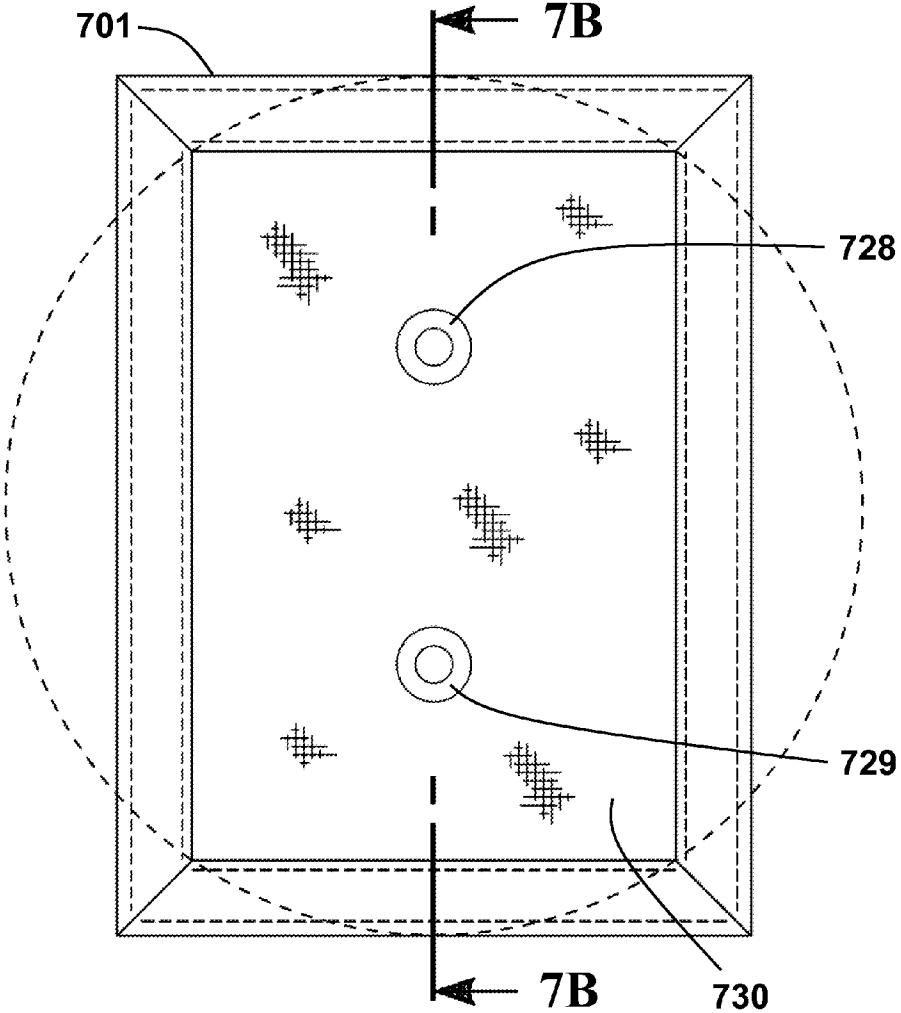
FIG. 7A is a perspective front view of an exemplary Main Badge Holder.

FIG. 7A depicts a perspective front view of an exemplary main badge holder 701. The front surface of the main badge holder may comprise two aligned holes 728,729, e.g. metal or nylon eyelets, to accommodate a pin of a badge, which may prevent the wear and widening of the fabric of the badge mount receiver with time. Hook or loop elements of hook and loop fasteners 730 may be attached to the front surface of the main badge holder and/or the back surface of the main badge holder (not shown).

FIG. 7B depicts a cross-sectional view of the main badge holder. The main badge holder may comprise at least three backing members 750,751,752. A first backing member 750 may be joined with hook or loop elements of hook and loop fastening material to allow for mounting of a badge. A second backing member 751 may provide the outer surface opposite the first backing member, and may be joined with hook or loop elements of hook and loop fastening material to allow for mounting of a badge mount receiver. A third backing member 752 may be interposed between the first backing 750 member and the second backing member 751 to provide rigidity. The at least three backing members 750,751,752 may be sewn together, for example, with double stitching, with a border 740 to join the at least three backing members 750,751,752. The material for the third backing member 752 may be comprised of a sturdy and flexible material so that the badge may be prominently displayed therefrom and so that the badge will not substantially adversely affect the third backing member, even during prolonged use. The second backing member may contain two holes 728,729 containing aligned metal or nylon eyelets to accommodate the pin of a badge, which may prevent the wear and widening of the fabric of the main badge holder 701.

Figure 7C:
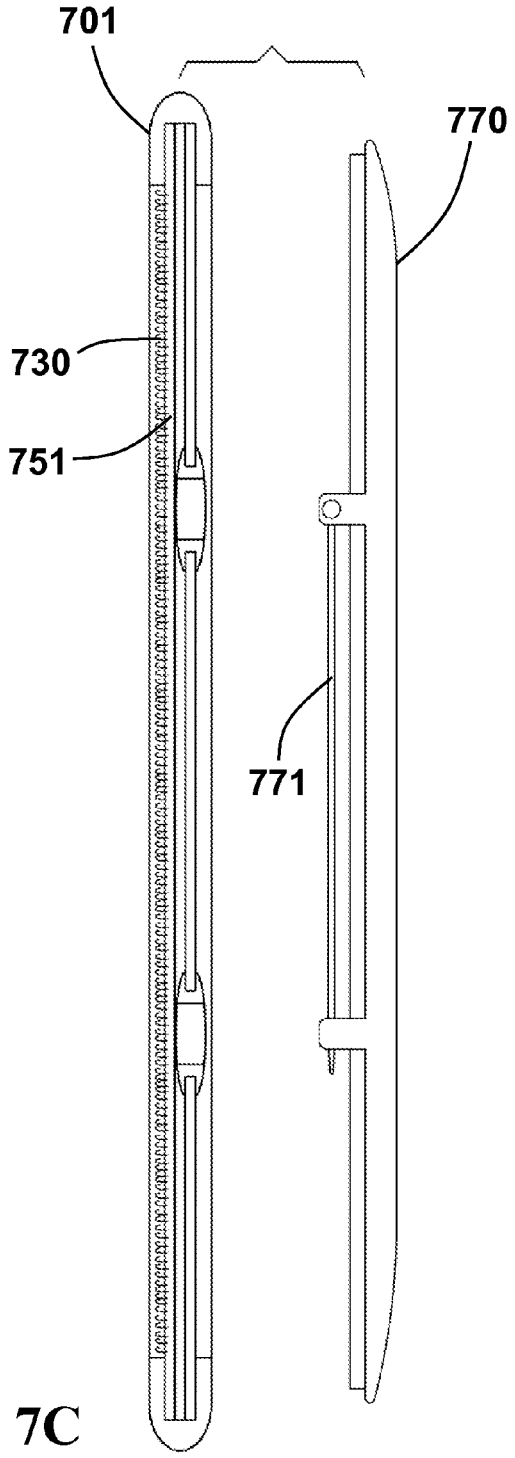
FIG. 7C is a cross-sectional view of an exemplary badge and an exemplary Main Badge Holder having a hook or loop element array of hook and loop means for detachably attaching to a Badge Mount Receiver.

FIG. 7C depicts a cross-sectional view of an exemplary badge 770 having a pin 771 and the main badge holder 701 having a hook and loop means 730 for detachably attaching to a badge mount receiver. The hook or loop elements of hook and loop fasteners 730 attached to the second backing member 751 may allow for the easy transfer of the main badge holder 701 between an exemplary badge mount receiver with lanyard and/or an exemplary badge mount receiver with strapping (not shown).

Figure 7D:
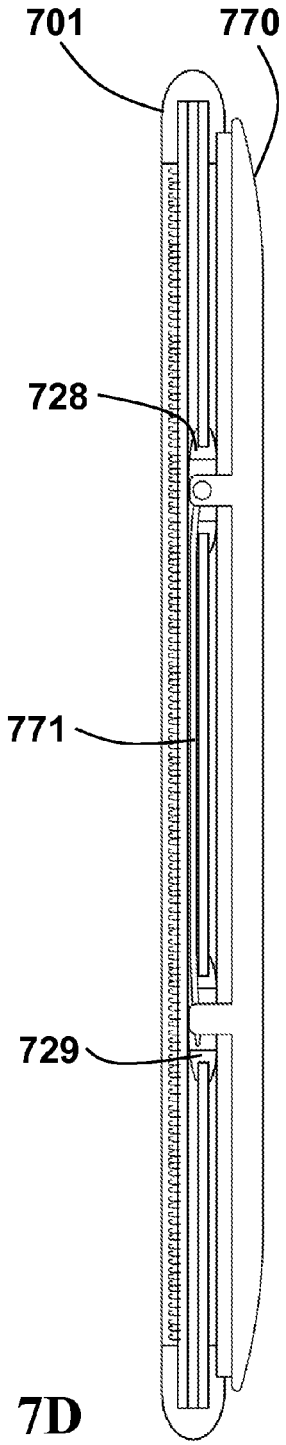
FIG. 7D is a cross-sectional view of an exemplary badge detachably attached to an exemplary Main Badge Holder.

FIG. 7D depicts an exemplary badge 770 detachably attached to the main badge holder 701. The pin 771 of the badge 770 is disposed through two aligned holes 728,729 in a front surface of the main badge holder.

Figure 8:
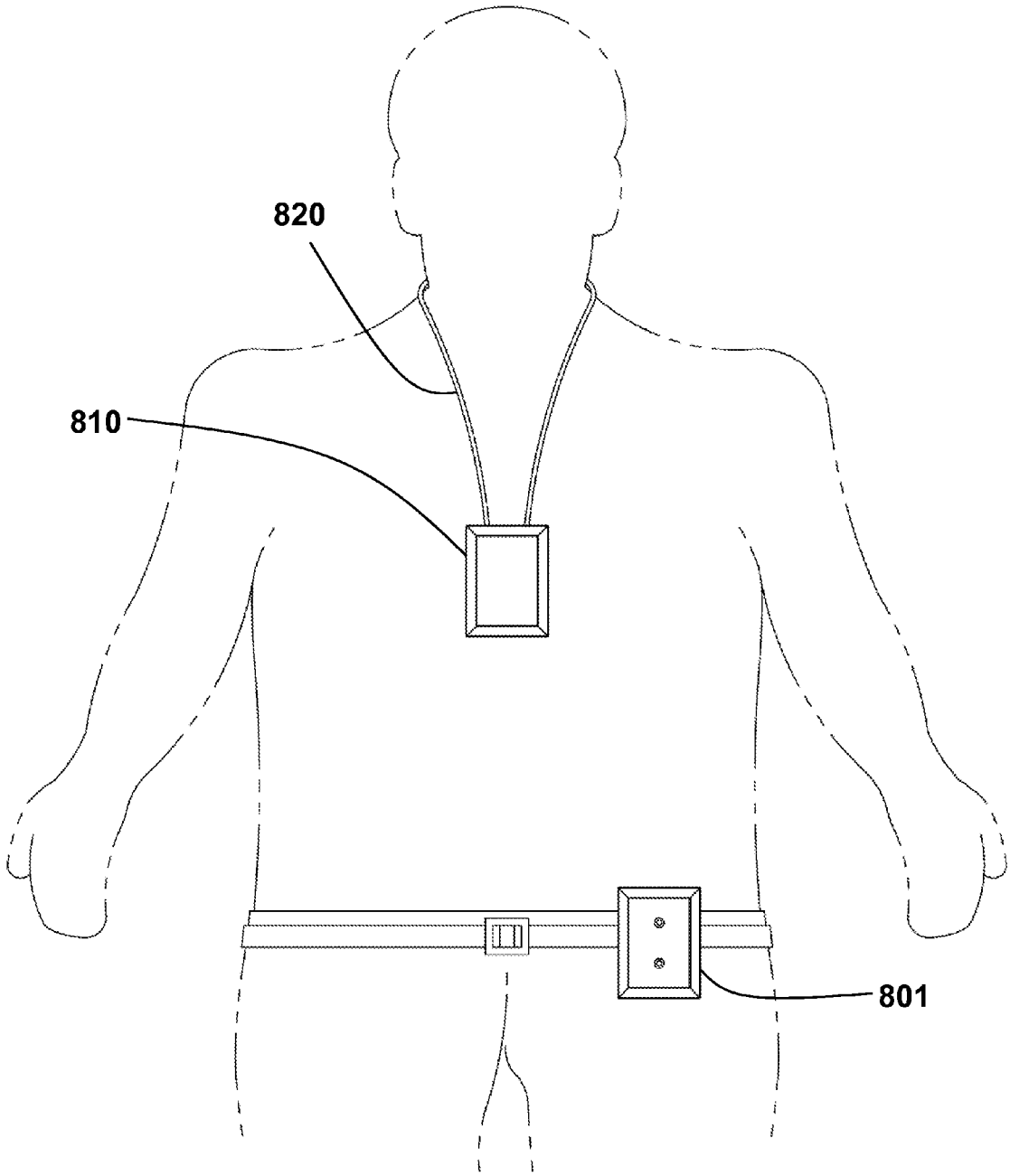
FIG. 8 depicts a person having an exemplary Main Badge Holder and an exemplary Badge Mount receiver.

FIG. 8 depicts a person having an exemplary main badge holder 801 detachably attached to an exemplary backing plate with strapping connected to a belt and a second exemplary backing plate 810 with lanyard 820 secured around a neck by the lanyard 820. The main badge holder 801 may be removed from the backing plate with strapping and detachably attached to the backing plate 810 with lanyard 820.

Figure 9:
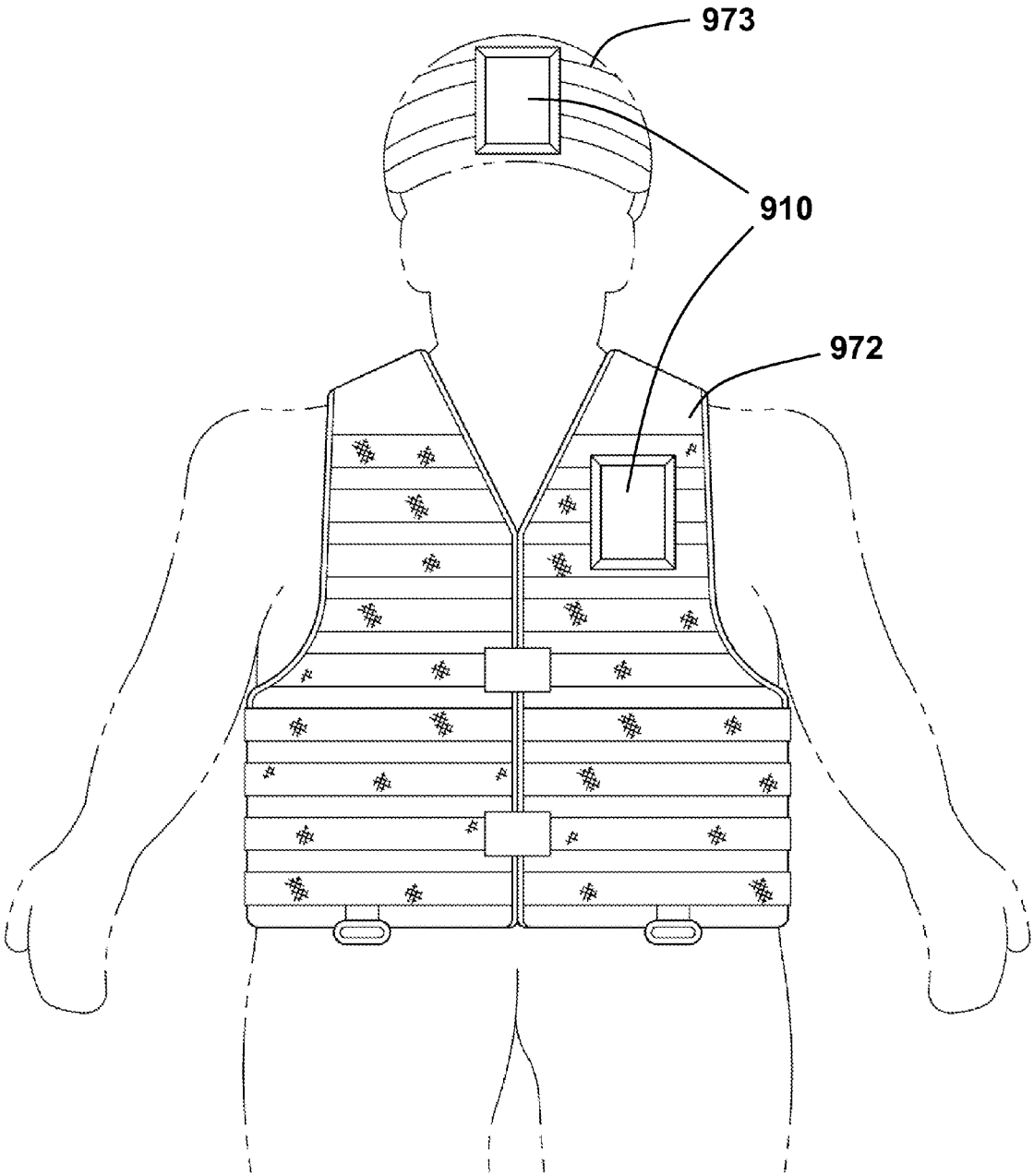
FIG. 9 depicts a person having an exemplary first Badge Mount Receiver and an exemplary second Badge Mount Receiver.

FIG. 9 depicts a person having a first badge mount receiver 910 mounted on a vest 972, and a second badge mount receiver 910 mounted to protective gear, e.g., a helmet and/or hat 973.

Figure 10:
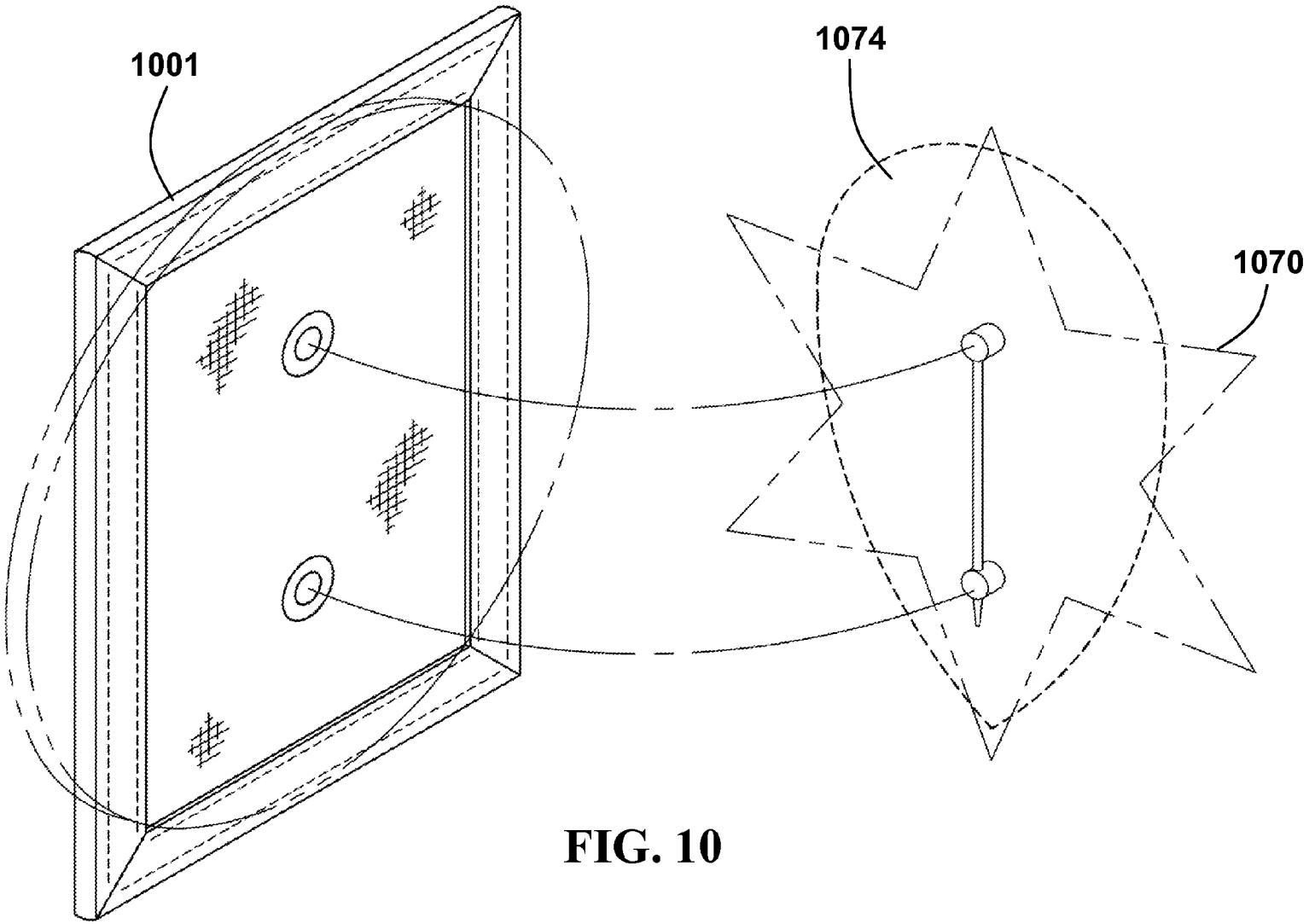
FIG. 10 depicts an exemplary badge having a backing material and pin.

FIG. 10 depicts a badge 1070 having a backing material 1074 and a pin. A badge may have the backing material 1074, e.g., leather, to prevent wear to the badge. The pin of the badge 1070 may have enough travel to attach to a main badge holder 1001 without removal of the backing material 1074. In some embodiments, the main badge holder may be circular or oval in shape (not shown).

It is contemplated that various combinations and/or subcombinations of the specific features and aspects of the above embodiments may be made and still fall within the scope of the invention. Accordingly, it should be understood that various features and aspects of the disclosed embodiments may be combined with or substituted for one another in order to form varying modes of the disclosed invention. Further it is intended that the scope of the present invention is herein disclosed by way of examples and should not be limited by the particular disclosed embodiments described above.

What is claimed is:

1. A badge holder comprising:

a main badge holder comprising at least three backing members, wherein a first backing member comprises a means for attaching a badge, a second backing member comprises at least one of: hook elements of a hook and loop fastening array and loop elements of a hook and loop fastening array, the hook and loop fastening array disposed on an outer surface of the second backing member, and a third backing member comprising a rigid material wherein the third backing member is interposed between the first backing member and the second backing member and the at least three backing members are stitched together; and at least one backing plate, the backing plate comprising at least three backing plate backing members:

a first backing plate backing member comprising at least three pieces of webbing fabric sewn horizontally to a local plane across a surface of the first backing plate backing member, wherein each of the at least three pieces of webbing fabric abut each other vertically to a local plane and are attached end to end, and wherein a center stitch is sewn orthogonally through a center of the at least three pieces of webbing fabric;

a second backing plate backing member comprising at least one of: hook elements of a hook and loop fastening array and loop elements of a hook and loop fastening array, the hook and loop fastening array disposed on an outer surface of the second backing plate backing member; and a third backing plate backing member comprising a rigid material, wherein the third backing plate backing member is interposed between the first backing plate backing member and the second backing plate backing member and the at least three backing plate backing members are stitched together;

wherein the at least one backing plate comprises at least one of: (a) lanyard, (b) strapping, (c) loop elements of a hook and loop fastening array, and (d) hook elements of a hook and loop fastening array;

wherein the main badge holder may be detachably attached to the at least one backing plate by the hook and loop fastening array.

2. The badge holder of claim 1 wherein the means for attaching a badge comprises two eyelets aligned vertically to a local plane.

3. The badge holder of claim 1 wherein each of the at least three pieces of webbing fabric is about two inches.

4. The badge holder of claim 1 wherein two pieces of webbing fabric are attached perpendicular to the at least three pieces of webbing fabric sewn horizontally, and wherein the two pieces of webbing fabric are sewed at one end proximate to a top edge of the first backing member and detachably attached at an opposite end of the first backing member by a detachable attachment device.

5. The badge holder of claim 4 wherein the detachable attachment device is at least one of: (a) button snaps and (b) hook or loop elements of hook and loop fasteners.

* * * * *